US006167953B1

(12) United States Patent
Kobayashi et al.

(10) Patent No.: US 6,167,953 B1
(45) Date of Patent: Jan. 2, 2001

(54) HEAT EXCHANGER TANK

(75) Inventors: Hideki Kobayashi; Katsumi Nakamura; Kenji Makino, all of Tokyo (JP)

(73) Assignee: Calsonic Corporation, Tokyo (JP)

( * ) Notice: Under 35 U.S.C. 154(b), the term of this patent shall be extended for 0 days.

(21) Appl. No.: 08/974,197

(22) Filed: Nov. 19, 1997

(30) Foreign Application Priority Data

Nov. 19, 1996 (JP) ..... 8-307656
Jun. 11, 1997 (JP) ..... 9-304019

(51) Int. Cl.[7] ..... F28F 9/02
(52) U.S. Cl. ..... 165/173; 165/67; 29/890.052
(58) Field of Search ..... 165/67, 173; 29/890.052

(56) References Cited

U.S. PATENT DOCUMENTS

| | | | | |
|---|---|---|---|---|
| 2,580,715 | * | 1/1952 | Baber | 165/175 |
| 3,866,675 | * | 2/1975 | Bardon et al. | 165/173 |
| 4,770,240 | * | 9/1988 | Dawson et al. | 165/176 |
| 5,172,762 | | 12/1992 | Shinmura et al. | 165/173 |
| 5,205,349 | * | 4/1993 | Nagao et al. | 165/67 |
| 5,214,847 | * | 6/1993 | Aoki | 29/890.043 |
| 5,236,042 | * | 8/1993 | Kado | 165/749 |
| 5,299,635 | * | 4/1994 | Abraham | 165/173 |
| 5,429,182 | | 7/1995 | Hanafusa | 165/67 |
| 5,570,737 | | 11/1996 | Tokutake | 165/67 |

FOREIGN PATENT DOCUMENTS

| | | | |
|---|---|---|---|
| 0 637 481 A1 | 2/1995 | (EP) . | |
| 0 760 457 A2 | 3/1997 | (EP) . | |
| 2-25693 | 1/1990 | (JP) | F28F 9/26 |
| 3-70994 * | 3/1991 | (JP) | 165/67 |

OTHER PUBLICATIONS

Patent Abstract of Japan, vol. 096, No. 004, Apr. 30, 1996, and JP 07 318288 A; Dec. 8, 1995.

* cited by examiner

*Primary Examiner*—Allen Flanigan
(74) *Attorney, Agent, or Firm*—Sughrue, Mion, Zinn, Macpeak & Seas, PLLC

(57) ABSTRACT

A cylindrical tank body is formed by folding a plate material which has a brazing filler metal layer and is formed from aluminum clad. One end of the plate material is extended along the other end of the tank body, and the thus-extended portion is brazed to the end.

8 Claims, 6 Drawing Sheets

HEAT EXCHANGER TANK

BACKGROUND OF THE INVENTION

1. Field of the Invention

The present invention relates to a heat exchanger tank which is a constituent element of a heat exchanger such as a radiator, an intercooler, or a heater core.

2. Description of the Prior Art

A heat exchanger such as that disclosed in; e.g., Japanese Utility Model Publication No. Hei. 3-31068, is known as a conventional heat exchanger such as a radiator or an intercooler.

FIG. 9 shows a heat exchanger described in the foregoing patent application. In this heat exchanger, a tank body 1 is formed by extrusion of aluminum, and tube holes 1*a* are formed in the surface of the tank body 1 facing a core 2.

The core 2 is formed by alternately stacking tubes 3 and corrugated fins 4 on over the other. A plate material 5 which is formed from aluminum clad with a brazing filler metal layer on both surfaces is attached to each side of the core 2.

The end of each of the tubes 3 is inserted into the corresponding tube hole 1*a* of the tank body 1. The tank body 1 and the core 2 are subjected to heat treatment in a brazing furnace while they are temporarily assembled together. The brazing filler metal layer of the plate material 5 is fused, to thereby braze the tube 3 to the tube holes 1*a* of the tank body On the other hand, a heat exchanger tank such as that disclosed in; e.g., Japanese Patent Publication No. Hei. 2-25693, is known as a conventional heat exchanger tank comprising a tank body to which a mount member is brazed.

FIG. 10 shows the heat exchanger of this type devised prior to the filing of the present patent application. In this heat exchanger tank, a tank body 6 is formed so as to have a rectangular cross-section by extrusion of aluminum.

A body 7*a* of a mount bracket 7 which is formed from aluminum clad is brazed to a mount surface 6*a* of the tank body 6, and the surface of the mount bracket 7 facing the tank body 6 is covered with a brazing filler metal layer. A leg 7*b* of the mount bracket 7 is brazed to a surface 6*b* adjacent to the mount surface 6*a* of the tank body 6.

A protuberance 7*c* protrudes from the mount bracket 7.

FIG. 11 shows the principal portion of the structure for mounting the foregoing heat exchanger tank to the vehicle body. The protuberance 7*c* of the mount bracket 7 is inserted into and supported by a through hole 9*a* formed in one side of a vehicle mount bracket 9 via a mount rubber 8.

The other side of the vehicle mount bracket 9 is fixed on an upper rail L of the vehicle body through use of a bolt B.

In the conventional heat exchanger shown in FIG. 9, the tank body 1 is formed by extrusion of aluminum. To thoroughly braze the end of the tube 3 to the tube hole 1*a* of the tank body 1, the plate material 5 which is formed from aluminum clad with a brazing filler metal layer is interposed between the tank body 1 and the core 2. Brazing metal fused from the brazing filler metal layer of the plate material 5 must be supplied to the tube holes 1*a*, thereby resulting in complicated structure of the core 2 and an increase in manufacturing cost.

More specifically, in a case where the tank body 1 is formed by extrusion of aluminum, it is very difficult to form a brazing filler metal layer on the tank body 1. For this reason, as shown in FIG. 9, there is a need for the plate material 5 which is formed from aluminum clad with a brazing filler metal layer is separately used in order to ensure brazing filler metal.

Further, in the heat exchanger tank shown in FIG. 10, the body 7*a* of the mount bracket 7 is raised from the mount surface 6*a* of the tank body 6 when the mount bracket 7 is brazed to the tank body 1, thereby resulting in brazing failures.

To prevent the brazing failures, the body 7*a* of the mount bracket 7 is temporarily fixed to the mount surface 6*a* of the tank body 6 by spot-welding S or point-welding prior to brazing the body 6*a*, which requires a large number of welding operations.

SUMMARY OF THE INVENTION

The present invention is aimed at solving the foregoing problem in the art, and the object of the invention is to provide a heat exchanger tank capable of ensuring temporal fixing of a mount bracket to a tank body in a ready manner.

In accordance with a first aspect of the present invention, there is provided a heat exchanger tank comprising: a tank body being formed by folding a plate material made of aluminum clad material having a brazing filler metal layer, and wherein a first end of the plate material extends along and is brazed to a second end of the plate material.

In accordance with a second aspect of the present invention, the first end and the second end of the plate material are overlapped and brazed to each other along an angular portion of the rectangular cross section.

In accordance with a third aspect of the present invention, a hole used for mounting an inlet or outlet pipe to the heat exchanger is formed in a surface opposite to a surface in which the first end of the plate material is brazed.

In accordance with a fourth aspect of the present invention, there is provided a heat exchanger tank comprising: a tank body formed by folding a plate material so as to have a rectangular cross section, a first end of the plate material extending along an outer side of an adjacent surface of the tank body; and a mount bracket including a main body brazed to a mount surface of adjacent to the adjacent surface of the tank body and a leg brazed to the adjacent surface; wherein the first end extended along the outer side of the adjacent surface is sandwiched between the main body and the leg of the mount bracket.

In accordance with a fifth aspect of the present invention, the plate material comprises aluminum clad material, and a side of the plate material which serves an outer peripheral surface of the tank body is coated with a brazing filler metal layer.

In a heat exchanger tank in accordance with the first aspect of the present invention, a cylindrical tank body is formed by folding a plate material made of aluminum clad material with a brazing filler metal layer.

One end of the plate material extends along and is brazed to the other end of the tank body.

In a heat exchanger tank in accordance with the second aspect of the present invention, a tank body is formed so as to have a rectangular cross section. Both ends of the plate material overlap each other and are brazed together along an angular portion.

In a heat exchanger tank in accordance with the third aspect of the present invention, a hole used for mounting an inlet or outlet pipe to the heat exchanger is formed in the surface opposite to the surface to which one end is brazed.

In a heat exchanger tank in accordance with the fourth aspect of the present invention, a tank body having a rectangular cross section is formed by folding a plate material in such a way that an end of the plate material extends along the exterior of the surface adjacent to the mount surface of the tank body to which the body of the mount bracket is mounted. The thus-extended portion is sandwiched between the main body and the leg of the mount bracket, thereby temporarily fixing the mount bracket to the tank body.

In the heat exchanger tank in accordance with the fifth aspect of the invention, the plate material comprises aluminum clad material, and the side of the plate material which will be the outer peripheral surface of the tank body is coated with a brazing filler metal layer.

The body and the leg of the mount bracket are brazed to the tank body by means of a brazing filler metal layer of the plate material.

DETAILED DESCRIPTION OF THE PREFERRED EMBODIMENTS

By reference to the accompanying drawings, embodiments of the present invention will be described in detail.

Figure 1:
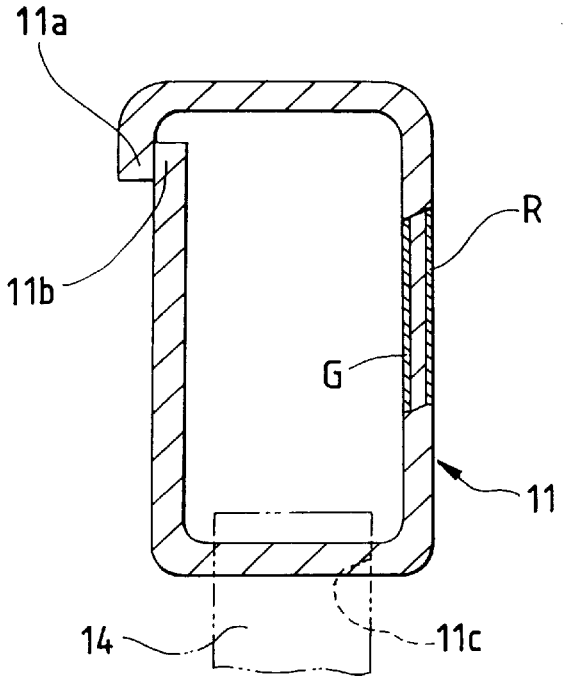
FIG. 1 is a cross-sectional view showing a heat exchanger tank in accordance with a first embodiment of the present invention.
Figure 2:
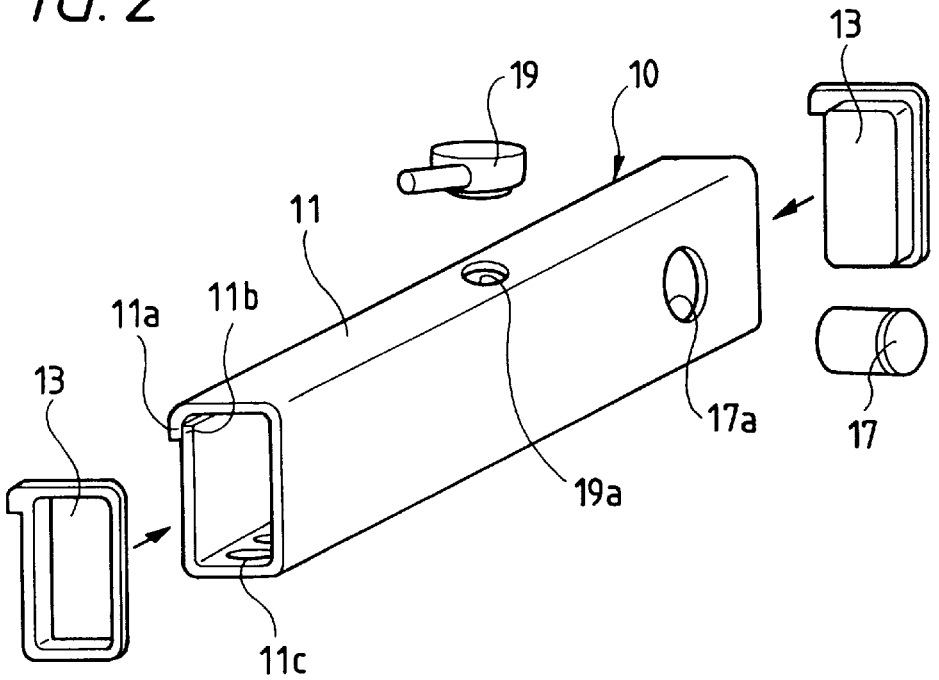
FIG. 2 is an exploded perspective view showing the heat exchanger tank shown in FIG. 1.

FIGS. 1 and 2 show a heat exchanger tank in accordance with a first embodiment of the present invention. In the present embodiment, the present invention is applied to a radiator tank.

In the present embodiment, a tank body 11 is formed so as to have a rectangular cross section.

Figure 3:
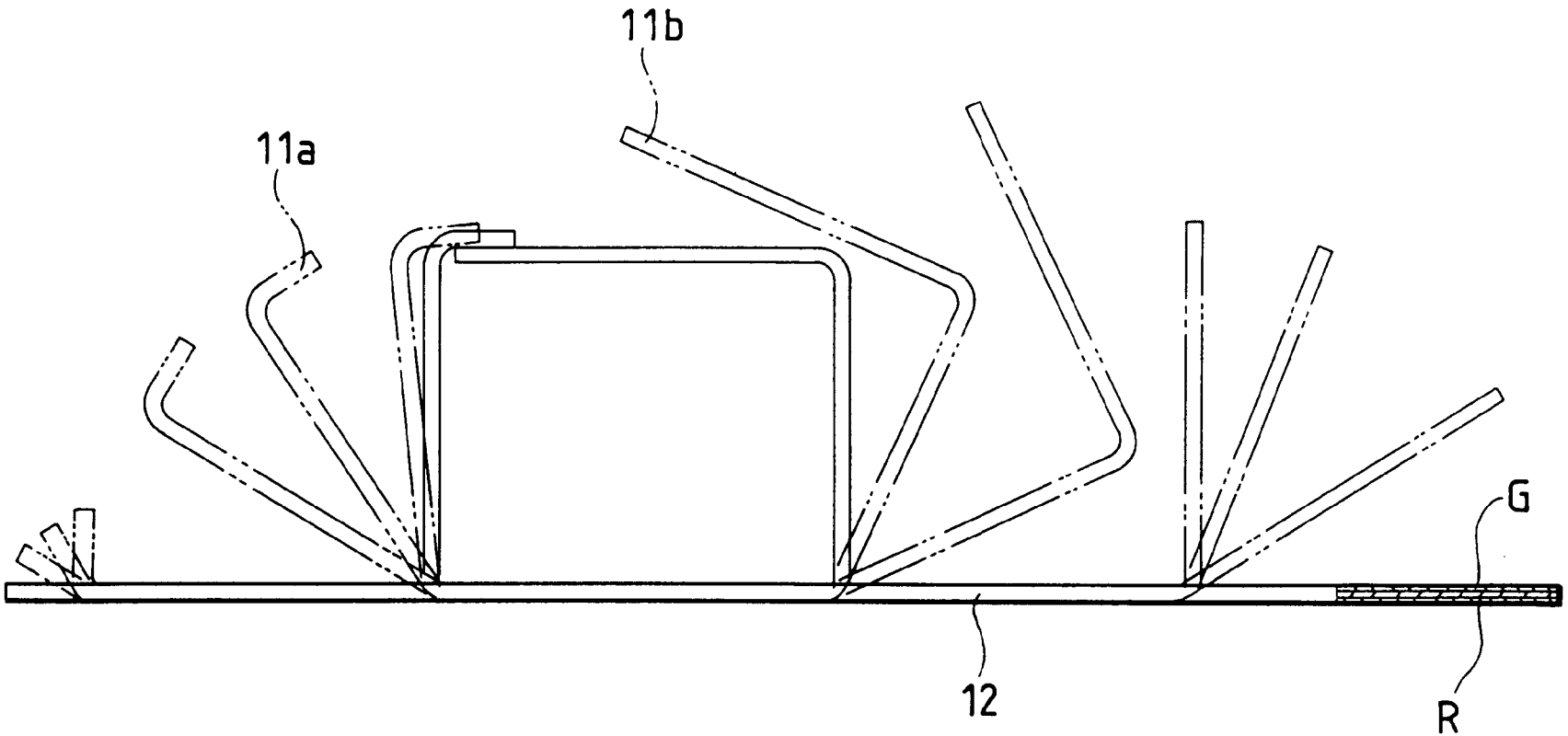
FIG. 3 is an explanatory view showing a method for forming a tank body of the heat exchanger tank shown in FIG. 1.

As shown in FIG. 3, the tank body 11 is formed by sequentially rolling a plate material 12.

In the present embodiment, aluminum clad material is used for the plate material 12. The surface of the plate material 12 which will be an exterior surface of the tank body 11 is covered with a brazing filler metal layer R, and the surface of the plate material 12 which will be an interior surface of the tank body 11 is covered with a sacrifice corrosion layer G used for surface corrosion.

One end 11*a* of the plate material 12 extends along the other end 11*b*of the tank body 11, and this extended portion is brazed to the end 11*b*.

As shown in FIG. 2, tube holes 11*c* are formed at intervals in one surface of the tank body 11 in a longitudinal direction.

The tank body 11 corresponds to the upper tank 10 of the radiator which will be described later. A mount hole 19*a* used for receiving a filler neck 19 is formed in the surface opposite to the surface in which the tube holes 11*c* are formed, and the filler neck 19 is brazed to the mount hole 19*a*.

A mount hole 17*a* for receiving an inlet pipe 17 is formed in the surface opposite to the surface to which the end 11*a* is brazed, and the inlet pipe 17 is brazed to the mount hole 17*a*.

An end plate 13 made of aluminum is fitted and brazed to each side of the tank body 11.

Figure 4:
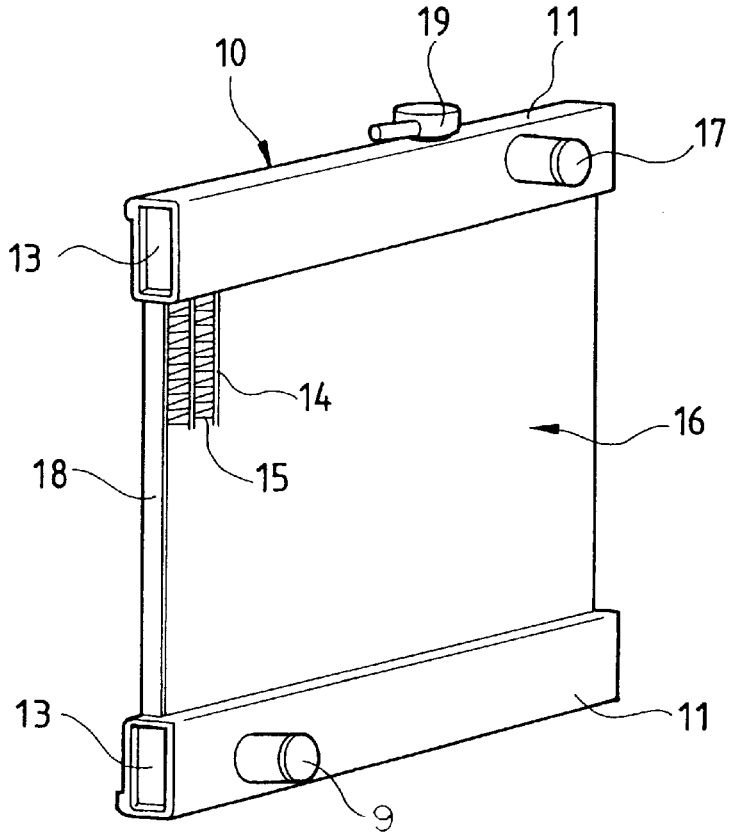
FIG. 4 is a perspective view showing a state in which the heat exchanger tank shown in FIG. 1 is temporarily attached to a core.

As shown in FIG. 4, for example, the foregoing heat exchanger tank is attached to each side of a core 16 of the radiator.

The core 16 is formed by stacking tubes 14 each having a brazing filler metal layer on an outer surface thereof and corrugated fins 15, and reinforces 18 are attached to both sides of the core 16.

An upper tank body 11 is formed by folding the plate material 12, and by forming, in one surface of the tank body 11, the tube holes 11*c*, the mount hole 19*a* used for receiving the filler neck 19, and the mount hole 17*a* used for receiving the inlet pipe 17. Further, the filler neck 19, the inlet pipe 17, outer surface of which is to be clad with a brazing filler metal layer, and the end plates 13 are temporarily attached to the tank body 11 in which the end 11*a*of the tank body is temporarily superimposed on the end 11*b*. Such an upper tank body 11 is attached to the upper side of the core 16, and the tubes 14 are fitted into the tube holes 11*c*of the tank body 11.

A lower tank body 11 is formed by folding the plate material 12, and by forming, in one surface of the tank body 11, the tube holes 11*c*, and the mount hole 17*a* used for receiving an outlet pipe 9. Further, the outlet pipe 9A, the outer surface of which is to be clad with a brazing filler metal layer, and the end plates 13 are temporarily attached to the tank body 11 in which the end 11*a*of the tank body is temporarily superimposed on the end 11*b*. Such a lower tank body 11 is attached to the lower side of the core 16, and the tubes 14 are fitted into the tube holes 11*c*of the tank body 11.

Noncorrosive flux is applied to the thus-temporarily assembled radiator and is subjected to heat treatment in a brazing furnace, whereby the components of the radiator are integrally brazed together.

More specifically, the tubes 14 are brazed to the tube holes 11*c* by means of the fused brazing filler metal layer R of the tank body 11 and the brazing material of the tube 14. Further, the ends 11*a*, 11*b* of the tank body 11 are brazed together, and additional components are also brazed to the tank body 11.

In the heat exchanger tank having the foregoing configuration, the cylindrical tank body 11 is formed by folding the plate material 12 which has a brazing filler metal layer R and is formed from aluminum clad. The end 11*a*of the plate material 12 is extended along the end 11*b*of the tank body 11, and the thus-extended portion is brazed to the end 11*b*. As a result, the brazing filler metal layer R can be readily and thoroughly formed over the tank body 11.

Accordingly, in comparison with a case where the tank body is formed by extrusion of aluminum, there is eliminated the need for ensuring brazing material by use of additional plate material which is formed from aluminum clad with a brazing filler metal layer. Therefore, the ends of the tubes 14 can be readily and reliably brazed to the tube holes 11*c* of the tank body 11.

In the foregoing heat exchanger tank, the mount hole 17*a* for receiving the inlet pipe 17 or the outlet pipe 9 are formed in the surface of the tank body 11 opposite to the surface to which the end 11*a*is brazed. The height of the tank body 11 can be set to a dimension similar to the diameter of the inlet pipe 17 or the outlet pipe 9. Further, although it is difficult to form the mount hole 17*a* over the overlapped portion of the ends 11*a*and 11*b*, such a complicated step can be omitted in this embodiment.

In the aforementioned embodiment, the tank body is formed so as to have a rectangular cross section. However, the cross-section shape is not limited to the rectangular, and technical idea of the present invention can be applied to the other type tank body which has a circular cross section or other shapes.

Figure 5:
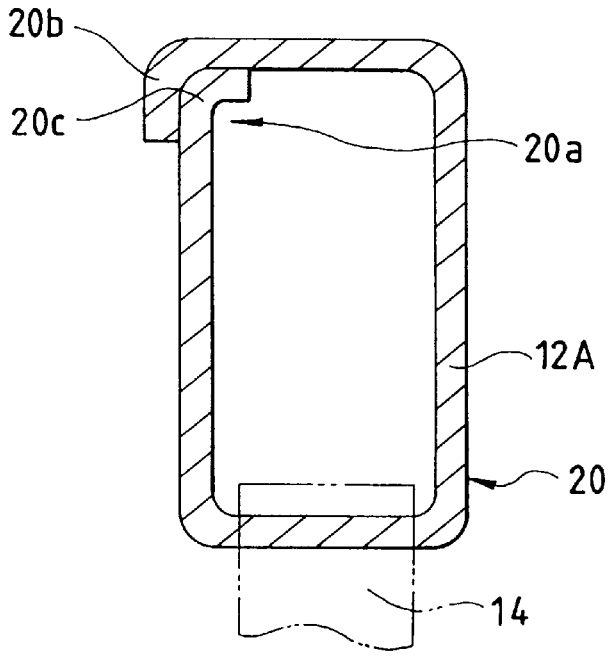
FIG. 5 is a a cross-sectional view showing a heat exchanger tank in accordance with a second embodiment of the present invention.

FIG. 5 shows a heat exchanger tank in accordance with a second embodiment of the present invention. In the present embodiment, one end 20*b* overlaps the other end 20*c* along an angular portion 20*a* of a tank body 20 having a rectangular cross section. The ends 20*b* and 20*c* of a plate material 12A are brazed to each other in the vicinity of the angular portion 20*a*.

Even in the heat exchanger tank in accordance with the second embodiment, an advantageous result similar to that obtained in the first embodiment can be ensured. In the second embodiment, the end 20*b* overlaps the end 20*c* of the plate material 12A along the angular portion 20*a* of the tank body 20. The thus-overlapping ends are brazed together. As a result, the strength of the angular portion 20*a* on which stress concentrates can be increased. The risk of fractures in the angular portion 20*a* can be reduced.

Figure 6:
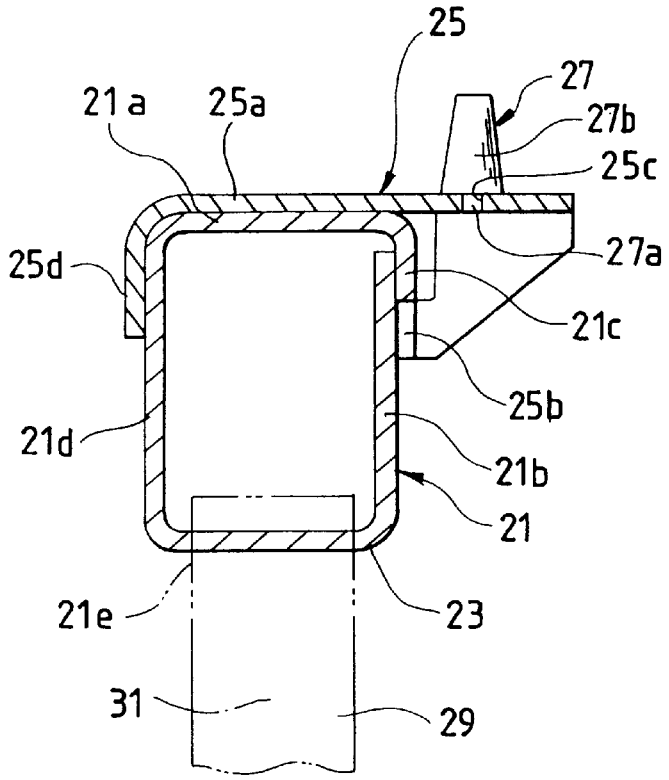
FIG. 6 is a cross-sectional view showing a heat exchanger tank in accordance with a third embodiment of the present invention.
Figure 7:
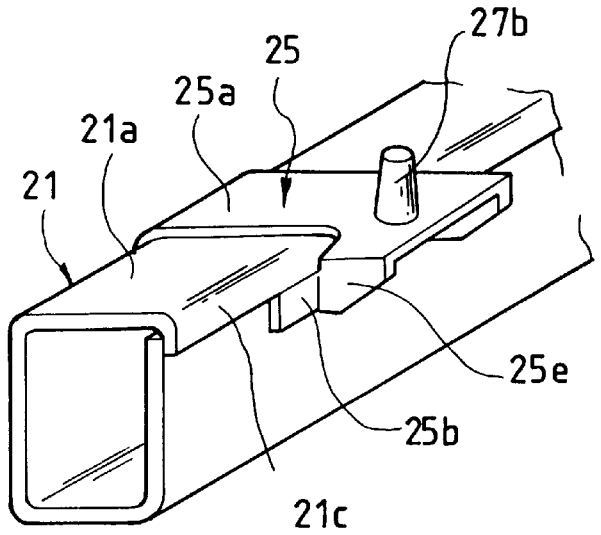
FIG. 7 is a perspective view showing the heat exchanger tank shown in FIG. 6.

FIGS. 6 and 7 show a heat exchanger tank in accordance with a third embodiment of the present invention. In the drawings, reference numeral 21 designates a tank body of a radiator.

The tank 21 is formed so as to have a rectangular cross-section by folding a plate material 23 by means of rolling operation as described in the first embodiment.

A body 25*a* of a mount bracket 25 is brazed to a mount surface 21*a* of the tank body 21.

A leg 25*b* integrally formed with the mount bracket 25 is brazed to a surface (hereinafter referred to as an adjacent surface) 21*b* adjacent to the mount surface 21*a* of the tank body 21.

A through hole 25*c* is formed in the mount bracket 25 so as to permit receipt of a projection 27*a* of a pin member 27.

The pin member 27 is brazed to the mount bracket 25 and comprises a protuberance 27*b* which protrudes upward.

In the present embodiment, the end of the plate material 23 forming the tank body 21 extends along the exterior of the adjacent surface 21*b* of the tank body 21, to thereby constitute an extended portion 21*c*.

The extended portion 21*c* is sandwiched between the body 25*a* and the leg 25*b* of the mount bracket 25.

The body 25*a* of the mount bracket 25 extends along a surface 21*d* opposite to the adjacent surface 21*b* of the tank body 21, to thereby constitute a folded portion 25*d*.

As shown in FIG. 7, the leg 25*b* of the mount bracket 25 is integrally formed with the front ends of vertical portions 25*e* which are made by folding, at right angles, both sides of the area around the protuberance 27*b* of the mount bracket 25.

In the present embodiment, the plate material 23 constituting the tank body 21 is formed from aluminum clad material, and the side of the plate material 23 which will be the outer peripheral surface of the tank body 21 is coated with a brazing filler metal layer.

The plate material forming the mount bracket 25 is formed from aluminum clad material, and the side of the plate material which will be the outer peripheral surface of the mount bracket 25 is coated with a brazing filler metal layer.

In FIG. 6, the end of a tube 31 forming a core 29 is fitted into a surface 21*e* opposite to the mount surface 21*a* of the tank body 21.

Figure 8:
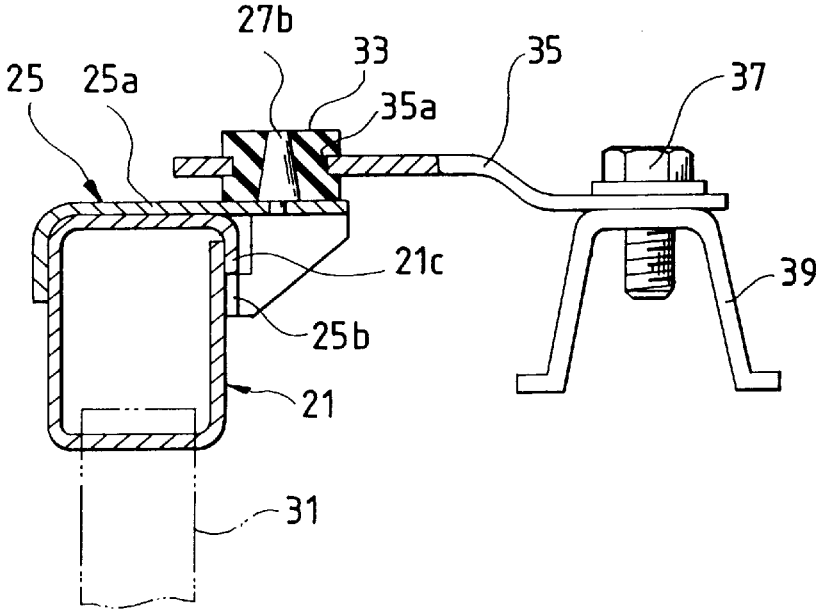
FIG. 8 is a cross-sectional view showing the structure of mounting the heat exchanger tank shown in FIG. 6 to the vehicle body.
Figure 9:
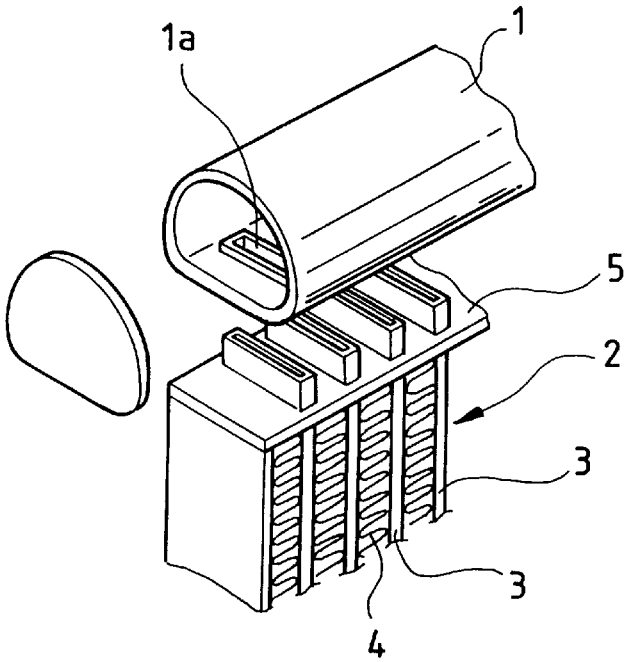
FIG. 9 PRIOR ART
FIG. 9 is a perspective view showing a conventional heat exchanger.
Figure 10:
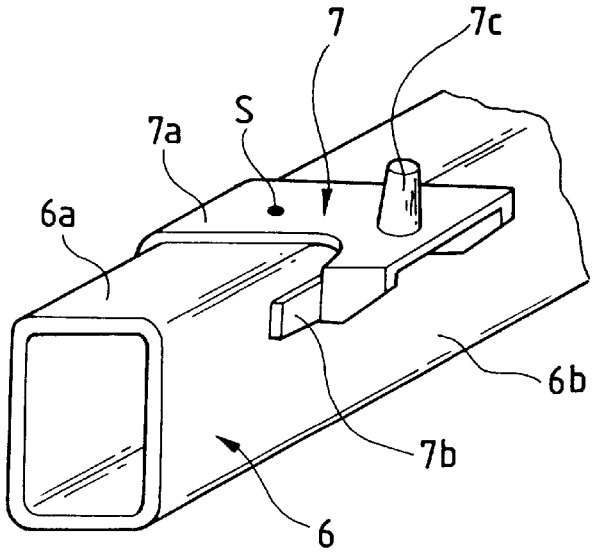
FIG. 10 PRIOR ART
FIG. 10 is a perspective view showing a conventional heat exchanger tank.
Figure 11:
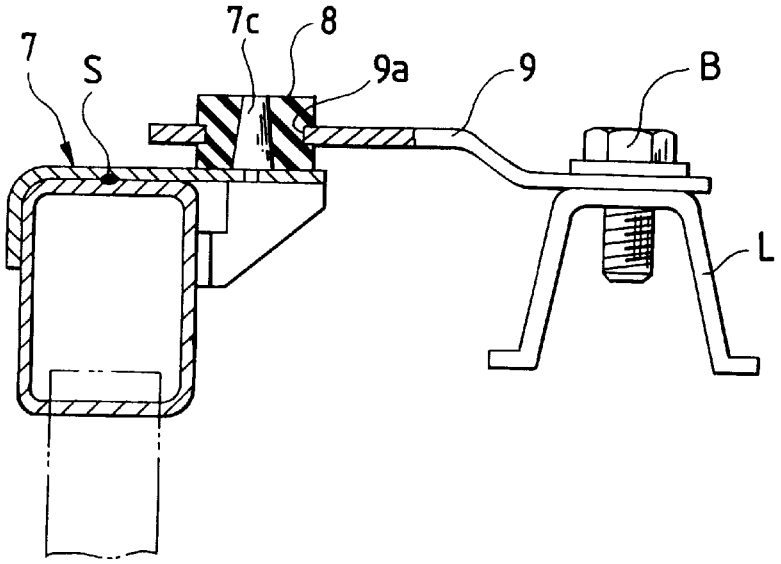
FIG. 11 PRIOR ART
FIG. 11 is a cross-sectional view showing the structure of mounting the conventional heat exchanger tank to the vehicle body.

FIG. 8 shows the principal elements of the structure for mounting the foregoing heat exchanger tank to the vehicle body. The protuberance 27*b* of the mount bracket 25 is inserted into and supported by a through hole 35*a* formed in one side of a vehicle mount bracket 35 via a mount rubber 33.

The other end of the vehicle mount bracket 35 is fixed to an upper rail 39 of the vehicle through use of a bolt 37.

In the foregoing heat exchanger tank, the mount bracket 25 is pressed by the mount surface 21*a* of the tank body 21, whereby the extended portion 21*c* of the tank body 21 is sandwiched between the body 25*a* and the leg 25*b* of the mount bracket 25. As a result, the body 25*a* and the leg 25*b* of the mount bracket 25 are held in position, so that the mount bracket 25 is temporarily fixed to the tank body 21.

In this state, the tank and the bracket are housed in a brazing furnace, and the radiator is integrally brazed to the bracket. More specifically, the body 25*a* of the mount bracket 25 is brazed to the mount surface 21*a* of the tank body 21, and the leg 25*b* is brazed to the adjacent surface 21*b*.

In the heat exchanger tank having the foregoing configuration, the end of the plate material 23 which forms the tank body 21 having a rectangular cross section extends along the exterior surface of the surface 21*b* adjacent to the mount surface 21*a* of the tank body 21. The extended portion 21*c* is sandwiched between the main body 25*a* and the leg 25*b* of the mount bracket 25, to thereby temporarily fix the mount bracket 25 to the tank body 21. As a result, the mount bracket 25 can be temporarily fixed to the tank body 21 in a ready and reliable manner.

Further, in the foregoing heat exchanger tank, the body 25*a* and the leg 25*b* of the mount bracket 25 are brazed to the tank body 21 through use of a brazing filler metal layer, and therefore the mount bracket 25 can be readily and reliably brazed to the tank body 21.

Although the foregoing embodiments have been described with reference to a case where the present invention is applied to the tank of the radiator, the present invention is not limited to this embodiment. For example, the present invention can also be applied to the heat exchanger tank such as a condenser.

Although aluminum clad material, one side of which forms the exterior surface of the bracket and is covered with a brazing filler metal layer is used for the plate material forming the mount bracket in the foregoing embodiments, the present invention is not limited to this embodiment. Simple aluminum plate material may be employed as the plate material for forming the mount bracket.

As has been described above, in a heat exchanger tank according to the present invention, a cylindrical tank body is formed by folding a plate material which has a brazing filler metal layer and is formed from aluminum clad. One end of the plate material is extended along the other end of the tank body, and the thus-extended portion is brazed to the end. As a result, the brazing filler metal layer can be readily and thoroughly formed over the tank body.

One end can overlap the other end along an angular portion of a tank body having a rectangular cross section and the ends are brazed to each other, thereby enabling an increase in the strength of the angular portion on which stress concentrates.

When a mount hole for receiving an inlet pipe or an outlet pipe is formed in the surface of the tank body opposite to the surface to which one end is brazed, the height of the tank body can be set to a dimension similar to the diameter of the inlet pipe or the outlet pipe.

Further, in a heat exchanger tank according to the present invention, the end of the plate material extends along the exterior of the surface adjacent to the mount surface of the tank body to which the body of the mount bracket is mounted. The thus-extended end of the plate material is sandwiched between the main body and the leg of the mount bracket, whereby the mount bracket is temporarily mounted to the tank body in a ready and reliable manner.

The body and the leg of the mount bracket may be brazed to the tank body by means of a brazing filler metal layer forming a tank body. As a result, the mount bracket can be readily and reliably brazed to the tank body.

What is claimed is:

1. A heat exchanger tank comprising:

an elongate tank body formed by folding a plate material made of aluminum clad material having a brazing filler metal layer, said tank body having a cross section with at least one angular portion;

wherein a first end of said plate material extends along and is brazed to a second end of said plate material;

wherein said first end and said second end are overlapped on a first surface of said elongate tank body; and wherein a hole through which coolant one of (1) inflows from an inlet pipe and (2) outflows to an outlet pipe is formed in a second surface which opposes said first surface, and tube holes to which tubes are fitable are formed on other surfaces of said elongate tank body.

2. The heat exchanger tank according to claim 1, wherein an outer surface of the tank body is cladded with the brazing filler metal layer.

3. The heat exchanger tank according to claim 2, wherein an internal surface of the tank body is cladded with a sacrifice corrosion layer.

4. The heat exchanger tank according to claim 1, wherein the tank body is formed so as to have a rectangular cross section.

5. A heat exchanger tank comprising:

a tank body formed by folding a plate material, a first end of the plate material extending along an outer side of an adjacent surface of the tank body; and a mount bracket including a main body brazed to a mount surface adjacent to the adjacent surface of the tank body and a leg brazed to the adjacent surface;

wherein the first end extended along the outer side of the adjacent surface is sandwiched between the main body and the leg of the mount bracket.

6. The heat exchanger tank according to claim 5, wherein the plate material comprises aluminum clad material, and a side of the plate material which serves an outer peripheral surface of the tank body is coated with a brazing filler metal layer.

7. The heat exchanger tank according to claim 5, wherein the tank body has a rectangular cross section.

8. The heat exchanger tank according to claim 1, wherein said first end and said second end of said plate material are bent and overlapped at said angular portion of said cross section of said tank body.

* * * * *